US010421206B2

(12) United States Patent
DeLise, Jr.

(10) Patent No.: US 10,421,206 B2
(45) Date of Patent: Sep. 24, 2019

(54) PROGRESSIVE SLITTING APPARATUS

(71) Applicant: MiniGraphics, Inc., Hauppauge, NY (US)

(72) Inventor: Stephen W. DeLise, Jr., West Islip, NY (US)

(73) Assignee: MINIGRAPHICS, INC., Hauppauge, NY (US)

( * ) Notice: Subject to any disclaimer, the term of this patent is extended or adjusted under 35 U.S.C. 154(b) by 418 days.

(21) Appl. No.: 14/447,138

(22) Filed: Jul. 30, 2014

(65) Prior Publication Data

US 2016/0031114 A1 Feb. 4, 2016

(51) Int. Cl.

| | |
|---|---|
| ***B62D 1/22*** | (2006.01) |
| ***B26F 1/18*** | (2006.01) |
| ***B26D 1/22*** | (2006.01) |
| ***B26D 1/20*** | (2006.01) |

(52) U.S. Cl.

CPC ..... *B26F 1/18* (2013.01); *B26D 1/205* (2013.01); *B26D 1/225* (2013.01)

(58) Field of Classification Search

CPC ..... B26D 1/1575; B26D 11/00; B26D 1/205; B26D 1/225

USPC ..... 83/882, 443, 444, 439, 505, 506

See application file for complete search history.

(56) References Cited

U.S. PATENT DOCUMENTS 390,034 A * 9/1888 Peckover ..... B23D 45/105 125/13.01
1,939,925 A 12/1933 Schwartz
2,369,221 A 2/1945 Dunsheath
2,623,586 A * 12/1952 Volpi ..... D06H 7/04 83/171
2,756,819 A * 7/1956 Judelson ..... B26D 1/035 156/88
2,897,893 A 8/1959 Rockstrom et al.
2,941,560 A * 6/1960 McCaffery ..... A22C 25/18 83/13
3,165,951 A * 1/1965 Lindquist ..... B26D 3/28 83/426
3,282,525 A 11/1966 Rehr
3,293,962 A 12/1966 Gianaris
3,538,802 A * 11/1970 Helm ..... B26D 3/161 83/165

(Continued)

FOREIGN PATENT DOCUMENTS

| | | |
|---|---|---|
| DE | 102008005775 | 7/2009 |
| JP | H0280234 | 3/1990 |
| JP | 2001162582 | 6/2001 |

OTHER PUBLICATIONS

European Search Report for corresponding EP Application EP15178742 dated Nov. 24, 2015.

*Primary Examiner* — Kenneth E Peterson

(74) *Attorney, Agent, or Firm* — Keusey & Associates, P.C.

(57) ABSTRACT

A slitting apparatus having an anvil cylinder with an outer cylindrical surface adapted to support the material as it conveys through the slitting apparatus. An in-line cutting assembly having a series of blades with cutting edges disposed within a common plane that is oriented perpendicular to the cylinder's central axis. The cutting edges are arranged in an arcuate line that spirals inwardly toward the outer circumferential surface whereby the blades progressively slice the material so that the in-line cutting assembly forms a singular continuous slit.

13 Claims, 5 Drawing Sheets

(56) References Cited

U.S. PATENT DOCUMENTS

| | | | | | |
|---|---|---|---|---|---|
| 3,706,251 | A * | 12/1972 | Wheeler | B23D 19/02 | 83/451 |
| 4,046,043 | A * | 9/1977 | Kistner | B26D 1/147 | 83/425.4 |
| 4,063,476 | A | 12/1977 | Edstrom | | |
| 4,131,103 | A * | 12/1978 | Ishizuka | B23D 45/105 | 125/13.01 |
| 4,245,530 | A * | 1/1981 | Frye | B23Q 1/03 | 83/122 |
| 4,329,895 | A * | 5/1982 | Perini | B26D 1/10 | 83/174 |
| 4,484,500 | A | 11/1984 | Reba et al. | | |
| 4,538,492 | A * | 9/1985 | Van Lue | B26D 1/03 | 198/531 |
| 4,541,405 | A * | 9/1985 | Schlough | B23D 15/10 | 125/23.01 |
| 4,793,227 | A * | 12/1988 | Stobb | B26D 1/035 | 83/151 |
| 4,983,155 | A * | 1/1991 | Stobb | B26D 1/626 | 493/361 |
| 5,117,805 | A * | 6/1992 | Pedrini | B23D 45/105 | 125/13.01 |
| 5,313,863 | A | 5/1994 | Aihara et al. | | |
| 5,860,348 | A * | 1/1999 | Morse | B26D 1/143 | 452/151 |
| 6,691,695 | B2 * | 2/2004 | Buechel | B23D 47/045 | 125/13.01 |
| 2004/0144226 | A1 * | 7/2004 | West | B26D 1/225 | 83/62 |

* cited by examiner

PROGRESSIVE SLITTING APPARATUS

BACKGROUND OF THE INVENTION

1. Field of the Invention

The invention relates to a progressive slitting apparatus.

2. The Prior Art

Frequently a workpiece, web or piece of material needs to be slit along its length into multiple strips. In the case of webs, many slitters or slitting apparatus have been proposed, primarily for single-ply webs, that is, thin webs of paper. U.S. Pat. No. 1,939,925 shows a Paper Slitting Apparatus for toilet paper where a perforating head 12 makes perforations across the width of a large roll. The perforating head 12 operates in conjunction with a bed roll 10 having grooves that receive the perforating blades on each revolution of the perforating head 12. The paper web is fed into the perforating head 12 by a backfeed roll 11 and fed from the perforating head 12 by a front feed roll 13. After the large roll is perforated, it is fed to a plurality of saw tooth slitters or cutters 14. Each slitter operates independently to completely slice through the paper web and form a plurality of narrow width, toilet paper rolls. U.S. Pat. No. 5,313,863 shows a similar device where slitting blades 12 aligned with grooves 21 in bed roll 2 form a series of parallel slits in a web. A further related device is disclosed in U.S. Pat. No. 3,293,962 where slitting blades 24, 26 aligned with grooves 22, 23 in anvils 16, 18 form a series of parallel slits in corrugated board.

U.S. Pat. No. 2,369,221 relates to the continuous production of paper strips where a pair of disc rollers 3 partially cut through opposite sides of a paper web to form two cuts that are spaced from each other in the width direction of the web. As the cut strips are pulled away from each other, the paper tears between the partial cuts to form two portions 10, 11 having half thickness. U.S. Pat. No. 4,484,500 also produces strips and waste ribbons from a web. A first slitter 78 cooperates with grooves 76 in anvil 20 to form slits on one side of the waste ribbon. Further downstream, a second slitter 102 cooperates with grooves 100 in anvil 99 to form slits on the other side of the waste ribbon. Waste ribbons from the edge of the web are carried away by removal device 90 after the first slitter, while waste ribbons from the middle of the web enter removal device 120 after the second slitter. U.S. Pat. No. 3,282,525 produces triangular shaped waste ribbons 45a, 45b and 45c in rolls of paper towels. A first slitter 26a, 26b and 26c makes a straight slit on one side of the triangular waste ribbons. A second slitter 35a, 35b and 35c is reciprocated across the width of web 25, initially away from the first slit to form the second leg of the triangle, and then back toward the first slit to complete the third leg of the triangle. The two slitting devices have independent motion controllers to move one radially and the other axially.

U.S. Pat. No. 2,897,893 entitled Score-Cut Slitting Mechanism utilizes a single slitting wheel to slit a running web. The slitting wheel is disposed within a housing including a pinion. A longitudinal bar including a rack is placed parallel to the cutter roll. The pinion can move the housing longitudinally along the rack to adjust the location of the slitter across the width of the web. The slitter includes the employment of both hydraulic pressure and pneumatic pressure to urge the slitting wheel against the web and cutter roll.

U.S. Pat. No. 4,063,476 entitled Method and Apparatus for Cutting a Continuously Moving Web includes a slide that moves along guides parallel to the roll. A circular cutter and return wheel are mounted on the cradle in opposed oblique orientations. To form a diagonal slit in the web, the cradle is pivoted into its engaged position where the circular cutter is pressed against the web and roll. The oblique position of the cutting wheel causes the slide to move across the web. After the diagonal slit is completed, the cradle pivots to the opposite side, where the return roller directs the slide back to the original start position.

Accordingly ii would be desirable to provide a slitter with multiple blades that progressively slice through a multi-ply or thick workpiece, web or material to form a single slit.

SUMMARY OF THE INVENTION

Accordingly, it is an object of the present invention to provide an apparatus for progressively slitting a workpiece.

It is another object to provide an apparatus that can slit multi-ply or thick workpieces.

It is a further object to provide an apparatus that can slit a web at speed.

It is another object to provide an apparatus where multiple slits can be made simultaneously.

It is a further object to provide an apparatus that can adjust the location of the slits across the width of the workpiece or web.

It is a further object to provide the apparatus with a workpiece handling system to grasp the workpiece as it conveys through the slitting apparatus.

These and other related objects are achieved by a slitting apparatus for slitting material fed in a downstream direction between an anvil and a cutting assembly. The anvil cylinder has a central axis and an outer cylindrical surface adapted to support the material as it conveys through the slitting apparatus. An in-line cutting assembly includes a series of blades with cutting edges disposed within a common plane that is oriented perpendicular to the cylinder's central axis. The cutting edges are arranged in an arcuate line that spirals inwardly toward the outer circumferential surface whereby the blades progressively slice the material so that the in-line cutting assembly forms a singular continuous slit.

The outer cylindrical surface is smooth and continuous and the distance between each of the cutting edges and the smooth cylindrical surface is different. The distance between each sequential cutting edge and the smooth cylindrical surface decreases in the downstream direction. The anvil cylinder rotates in the downstream direction to convey the material past cutting edges that are progressively closer to the anvil surface. The first cutting edge to encounter the material slices a layer of the material that is furthest from the anvil cylinder. The last cutting edge in the downstream direction is in contact with the smooth cylindrical surface of the anvil cylinder to completely sever the material.

Each blade is a rotating circular blade that is free spinning and rotates from contact with the material. A motor is provided for rotating the anvil cylinder. The slitting apparatus comprises a slitting station on a web processing lines, and wherein said motor is adapted to rotate the anvil cylinder so that the outer cylindrical surface moves at a speed equal to the web speed.

The slitting apparatus further includes a guide disposed lateral of the in-line cutting assembly to direct the material around the anvil cylinder as it conveys in the downstream direction. The guide includes belts that partially wrap around the anvil cylinder to hold material in contact with said anvil cylinder. The guide includes an inner belt that encircles said anvil cylinder and outer belt that overlies said inner belt in a region adjacent said series of cutting blades, whereby said inner belt and said outer belt sandwich the material to hold it flat against said outer cylindrical surface.

The in-line cutting assembly includes an arm that partially wraps around, and is spaced from, the anvil cylinder, wherein the blades are mounted on the arm. The arm is C-shaped and holds the last cutting edge in contact with the outer surface of the anvil cylinder. The arm is pivotable in the radial direction to alter the distance between the all the cutting edges, excluding the last cutting edge, and the anvil cylinder. The arm is slidable in the axial direction of the anvil cylinder to alter the location of the slit along the width of the material.

The slitting apparatus further includes a pair of end support panels disposed at each axial end of the anvil cylinder. A cylinder axle and axle bearings at each end of the anvil cylinder are mounted on the end support panels. A series of support rails extend between the end support panels and are radially spaced from the outer cylindrical surface of said anvil cylinder. The series of blades are mounted on said support rails.

The in-line cutting assembly includes an arm mounted on the support rails, wherein the series of blades are mounted on the arm. Two or more in-line cutting assemblies are provided to cut two or more slits into the material as it passes through the slitting apparatus in the downstream direction.

The slitting apparatus further includes a motion controller and an arm that supports the series of blades. The motion controller is connected between the support rails and the arm to adjust the position of the series of blades with respect to the outer cylindrical surface. A guide is mounted on the support rails adjacent to the arm for directing the material past the series of blades.

BRIEF DESCRIPTION OF THE DRAWINGS

The advantages, nature, and various additional features of the invention will appear more fully upon consideration of the illustrative embodiments now to be described in detail in connection with accompanying drawings. In the drawings wherein like reference numerals denote similar components throughout the views.

DETAILED DESCRIPTION OF THE PREFERRED EMBODIMENTS

Figure 1:
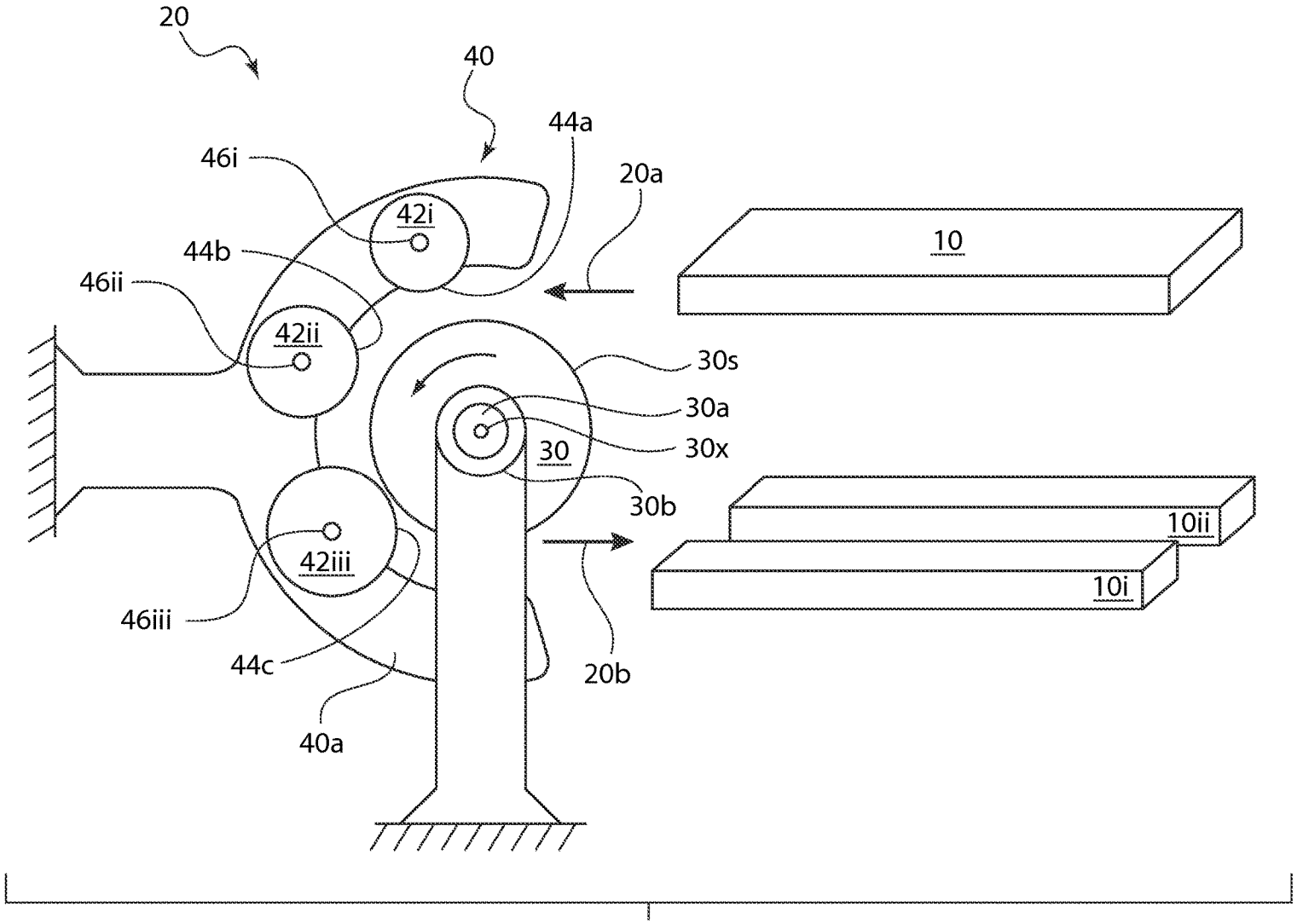
FIG. 1 is a side elevational view of a progressive slitting apparatus according to an embodiment of the invention.

Referring now in detail to the drawings, and in particular FIG. 1, there is shown a slitting apparatus 20 which includes as the primary components an anvil cylinder 30 and an in-line cutting assembly 40. A workpiece, web or piece of material 10 passes through slitting apparatus 20, by entering in the infeed direction 20*a* and exiting from the outfeed direction 20*b*. Material 10 that conveys from the infeed direction 20*a* to the outfeed direction 20*b* is considered as moving in the downstream direction. As material 10 conveys in the downstream direction through slitting apparatus 20, it passes in between the anvil cylinder 30 and the in-line cutting assembly 40. More particularly, material 10 conveys along a semi-circular path with the anvil cylinder 30 located radially inwardly of material 10, and in-line cutting assembly 40 located radially outwardly of material 10. The in-line cutting assembly 40 includes a series of blades 42 that progressively slit the material at increasingly greater depths along the same line to form a single through-cut that separates the material in to two separate parts.

The anvil cylinder 30 includes a smooth outer surface 30*s* and rotates about an axle 30*a* that is seated within bearings 30*h*. Geometrically, the anvil cylinder includes a central axis 30*x* that defines the center of rotation for the axle and cylinder. References to an axial direction, mean directions in or out of the page containing FIG. 1 or FIG. 2. References to a radial direction, mean directions in the plane of the page containing FIG. 1 or 2, for example a direction from the central axis 30*x* towards a blade axle 46*i*, 46*ii*, or 46*iii*. Bearings 30*b* are suitably supported in a slitting station for material processing. The anvil cylinder, and more particularly the anvil axis, may be positively rotated or motor-driven to convey material through the slitting station. In the case of processing a moving web, the axle may be rotated at a rate that causes the anvil's outer surface to move at a linear speed equal to the speed of the moving web.

The first blade 42*i* is furthest from anvil cylinder. Intermediate blades are disposed progressively closer to the cylinder as the material passes in the downstream direction. The last blade is in contact with the anvil's outer surface. In other words, the first blade encountered at the infeed is furthest from the anvil's outer surface, and the last blade encountered at the outfeed is closest to, e.g. in contact with, the anvil's outer surface. The workpiece has two opposed surfaces, with a lower back surface supported on the anvil's outer surface. The upper front surface faces the in-line cutting assembly 40. A point on the lower back surface of the workpiece that is aligned with the in-line cutting assembly will sequentially pass below all blades 42. In other terms, a line extending longitudinally along the workpiece aligned with the in-line cutting assembly will designate the location of a slit through the workpiece.

FIG. 1 shows a single in-line cutting assembly 40, where blades and their cutting edges 44*a*, 44*b*, and 44*c* are all disposed within a common plane. That common plane is oriented perpendicular to the central axis 30*x* of the anvil cylinder. Each cutting edge within the in-line cutting assembly makes a partial slice through some portion of the material along the same line. The in-line cutting assembly is well suited for multi-ply or thick material, where the first cutting edge 44*a* slits the outer layer of the material, cutting edge 44*b* slits the central layer, and cutting edge 44*c* slits the inner layer thereby separating the material into two sections.

As the material passes between anvil cylinder 30 and in-line cutting assembly 40, the material is driven through the slitting apparatus 20 by contact with the rotating anvil cylinder 30. In order to reduce friction between the blades 42 and material 10, blades 42 are circular blades which rotate about axles 46. For certain materials, the blades may be freely rotatable. The friction of the moving material along the sides of the blade would induce rotation while the edge of the blade contributed to the progressive slit. For other materials, the blades could be positively rotated or motor-driven. In the case of processing a moving web, the blades may be rotated at a rate that causes the cutting edges to move at a linear speed equal to the speed of the moving web. The location of blade axles 46*i*, 46*ii*, and 46*iii* are stationary with respect to anvil cylinder 30. While the blades 42*i*, 42*ii*, and

42*iii* are free to rotate about their respective axles 46*i*, 46*ii*, and 46*iii*, the blades cannot move away from anvil cylinder 30. The blades possess rotational freedom but restricted translational movement.

Figure 2:
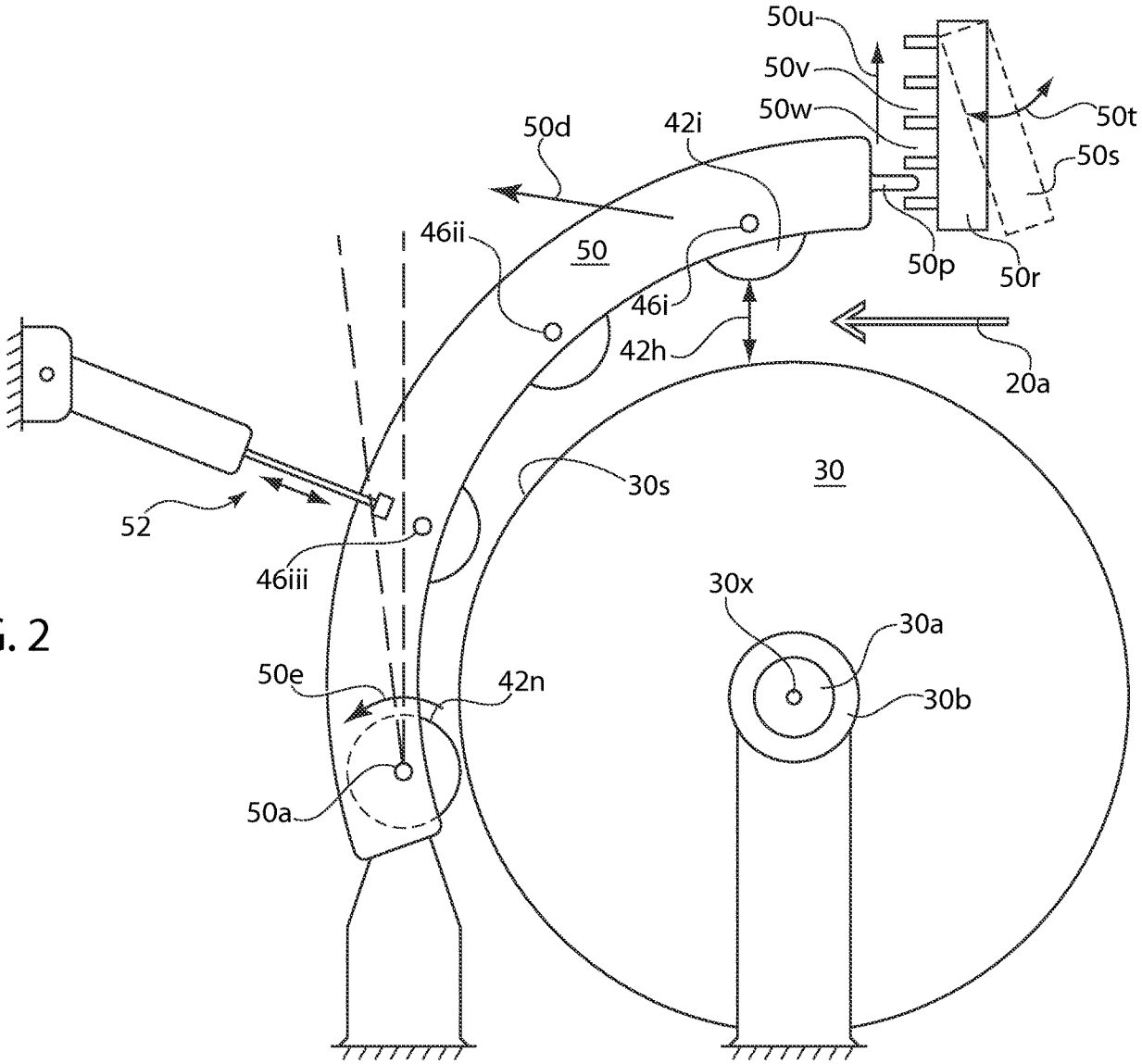
FIG. 2 is an enlarged side elevational view showing an embodiment of a cutting assembly thickness adjustment mechanism.

FIG. 1 shows arm 40*a* and anvil cylinder 30 in fixed positions relative to each other. In certain instances it may be desirable to change the position of the first blade in the infeed direction. For a workpiece of ¼ inch thick and high density, the first blade 42*i* may be set at a height 42*h* that is slightly less than ¼ inch from the outer surface 30*s* of the anvil cylinder 30, as shown in FIG. 2. If a thicker workpiece is to be (progressively slit, pivoting arm 50 can be moved in direction 50*d* to increase the opening at the infeed. For example, a ½ inch thick workpiece of medium density, may be most effectively slit by setting the first blade at a height 42*h* slightly less than ½ inch from the outer surface 30*s* of anvil 30.

As can be appreciated, the last blade 42*n* is in contact with outer surface 30*s* of anvil cylinder 30 to complete the slit that is started by the previous blades. Accordingly last blade 42*n* cannot be moved, and its axle 50*a* will serve as the pivot point for arm 50, as indicated by arrow 50*e*. One embodiment of an arm pivoting mechanism includes a pin 50*p* that is selectively retained in one of the slots of a rack 50*r*. To move arm 50, in the case of increasing height 42*h* at the infeed 20*a*, rack 50*r* is turned counterclockwise along direction 50*t* to an unlocked position 50*s* (shown in dotted line). A drive system pivots arm 50 in direction 50*d*, and pin 50*p* moves upwardly in direction 50*u*. The drive system may include a piston-cylinder unit 52, a servomotor or other suitable precise motion controllers. Pin 50*p* is then aligned with slot 50*w* or 50*v* and rack 50*r* is turned back clockwise from the unlocked position 50*s* (shown in dotted line) back to the original locked position of rack 50*r* (shown in solid line).

Movement of pivoting arm 50 increases the height 42*h* of blade 42*i* from the outer surface 30*s*. The intermediate blades will be moved away from outer surface also. Each intermediate blade will be moved a smaller distance away. The last blade will not move at all. In other terms, the cutting edges, except for the last blade 42*n*, can be moved to alter their radial distance to axis 30*x*. Since outer surface is at a fixed distance from axis 30*x*, altering the radial distance of the blades, will change their distance to outer surface. In the embodiment of FIG. 2, the first three blades are provided with a radial translational adjustment with respect to the outer surface 30*s* of anvil cylinder. Once the adjustment is complete, arm 50 is locked in place, and all blades will possess rotational freedom but restricted radial translational movement.

The adjustment of the width of the infeed direction may be useful if the slitting apparatus is used on a line that manufactures pamphlet labels in one manufacturing run and booklet labels in another run. The pamphlet labels may have 6 plies, including a label web, a 4 sheet pamphlet and overlaminate. The first blade would pre-slit the outer plies consisting of the overlaminate; the intermediate blades would intermediately slit the intermediate plies consisting of the sheets of the pamphlet; and the last blade would slit the label web completely severing the web into two sections. The arm 50 could then be adjusted to accommodate thicker workpieces. The thicker workpiece may comprise booklet labels having 10 plies including a label web, an 8 sheet page booklet and overlaminate. The first blade would pre-slit the outer plies consisting of the overlaminate and first page (s) of the booklet; the intermediate blades would intermediately slit the intermediate plies consisting of the middle and last pages of the pamphlet; and the last blade would slit the label web completely severing the web into two sections.

Figure 3:
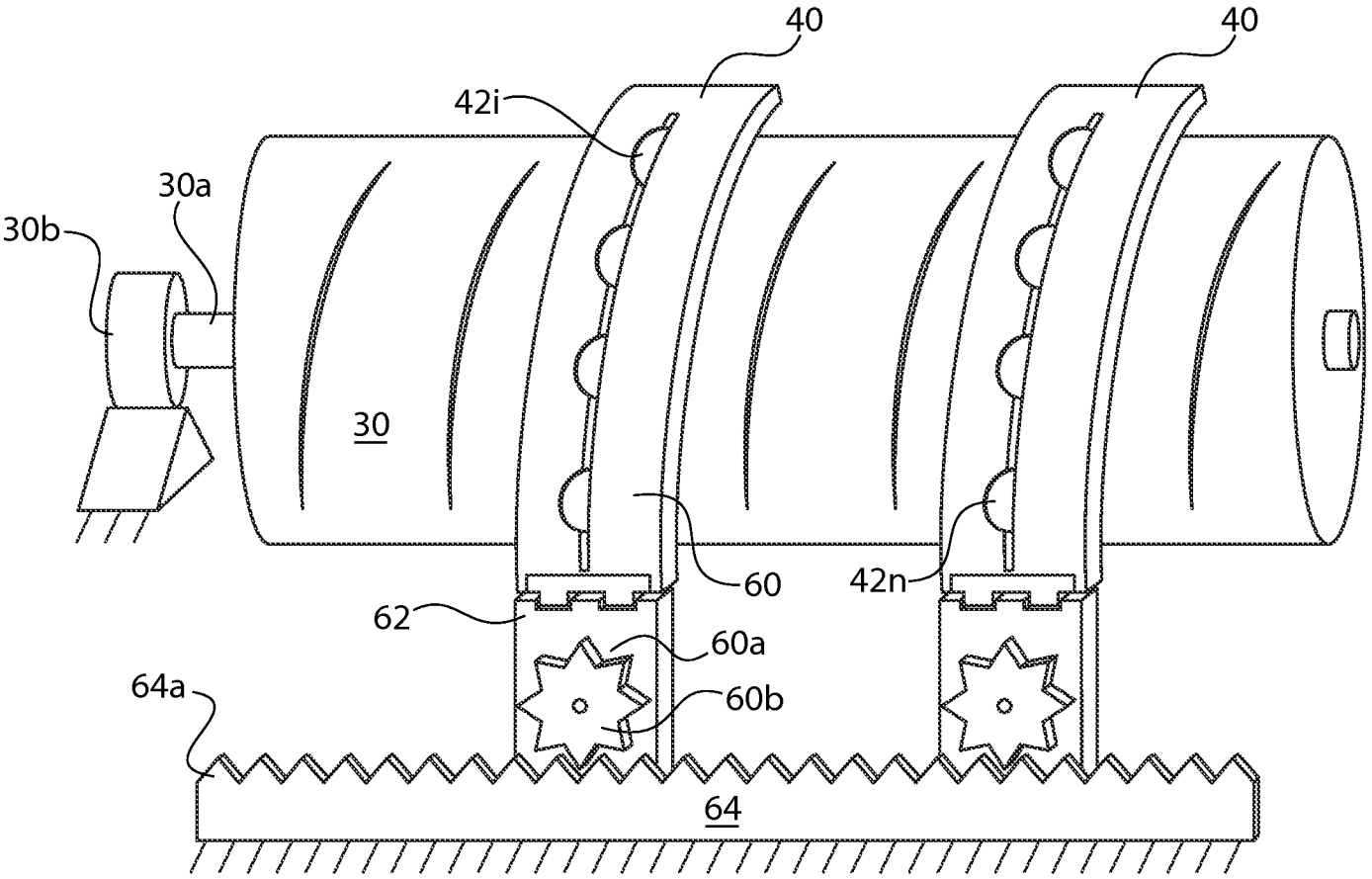
FIG. 3 is a back side perspective view showing another embodiment of a cutting assembly width adjustment mechanism.

FIG. 3 shows an embodiment for supporting multiple in-line cutting assemblies 40. More particularly, the support includes a rail 64 that extends parallel to the anvil cylinder 30. Sliding arms 60 are pivotally mounted to base 60*a* via hinges 62. The rail 64 is equipped with a rack 64*a* along its length. The base includes a pinion 60*b* that cooperates with rack 64*a* to adjust the position of base 60*a*. In manufacturing different products, it may be necessary to adjust the location of slits formed in the material. This may be accomplished by moving arm 60 away from anvil cylinder temporarily to avoid contact. A servo-motor or other precise motion controller then rotates pinion 60*b* to slide arm 60 to anew location along the width of anvil cylinder and the material. Arm 60 is pivoted back in to place, so that the last blade is in contact with the outer surface of anvil cylinder. A drive motor rotates anvil cylinder 30 and material is conveyed past the blades 42 on arm 60. Multiple slits are now formed on the workpiece, where the location of those slits may be adjusted along the width of the material, anvil, or rack 64*a*. In the embodiment of FIG. 3, each sliding arm 60 is provided with an axial translational adjustment with respect to the outer surface 30*s* of anvil cylinder. Once the adjustment is complete, arm 60 is locked in place, and all blades will possess rotational freedom but restricted axial translational movement.

FIG. 2 illustrates an embodiment for adjusting the height of the blades from the anvil surface to accommodate workpieces of different thicknesses. FIG. 3 illustrates an embodiment for adjusting the location of the cutting assembly across the width of the workpiece. This may be considered radial and axial adjustment, respectively. In a further embodiment, both radial and axial adjustment may be provided on the slitting apparatus. As described above in connection with FIG. 3, sliding arm 60 is pivoted away from anvil cylinder 30 before sliding to a new axial location. After the arm has reached its new location, the sliding arm is pivoted back towards anvil cylinder to the operation position. When the arm is pivoted back towards the anvil cylinder, a height adjustment system may be provided. Accordingly, when the sliding arm 60 is moved to a new location the height 42*h* of the blades may also be adjusted, thus providing both radial and axial adjustment.

The pivot mechanism from FIG. 2 may be added to the apparatus of FIG. 3. For example, rack 50*r* may be dimensioned to extend along the entire width of anvil cylinder 30. Piston-cylinder units 52 are provided for each sliding arm 60 and may slide along tracks to enable pivoting of the arm 60 at any axial location along the anvil cylinder. Such a combined radial and axial adjustment system would have an arm hinge that moves all blades away from anvil cylinder for movement. After axial adjustment the last blade is brought back into contact with anvil cylinder, while the remaining blades may have their distances to the anvil cylinder adjusted.

Figure 4:
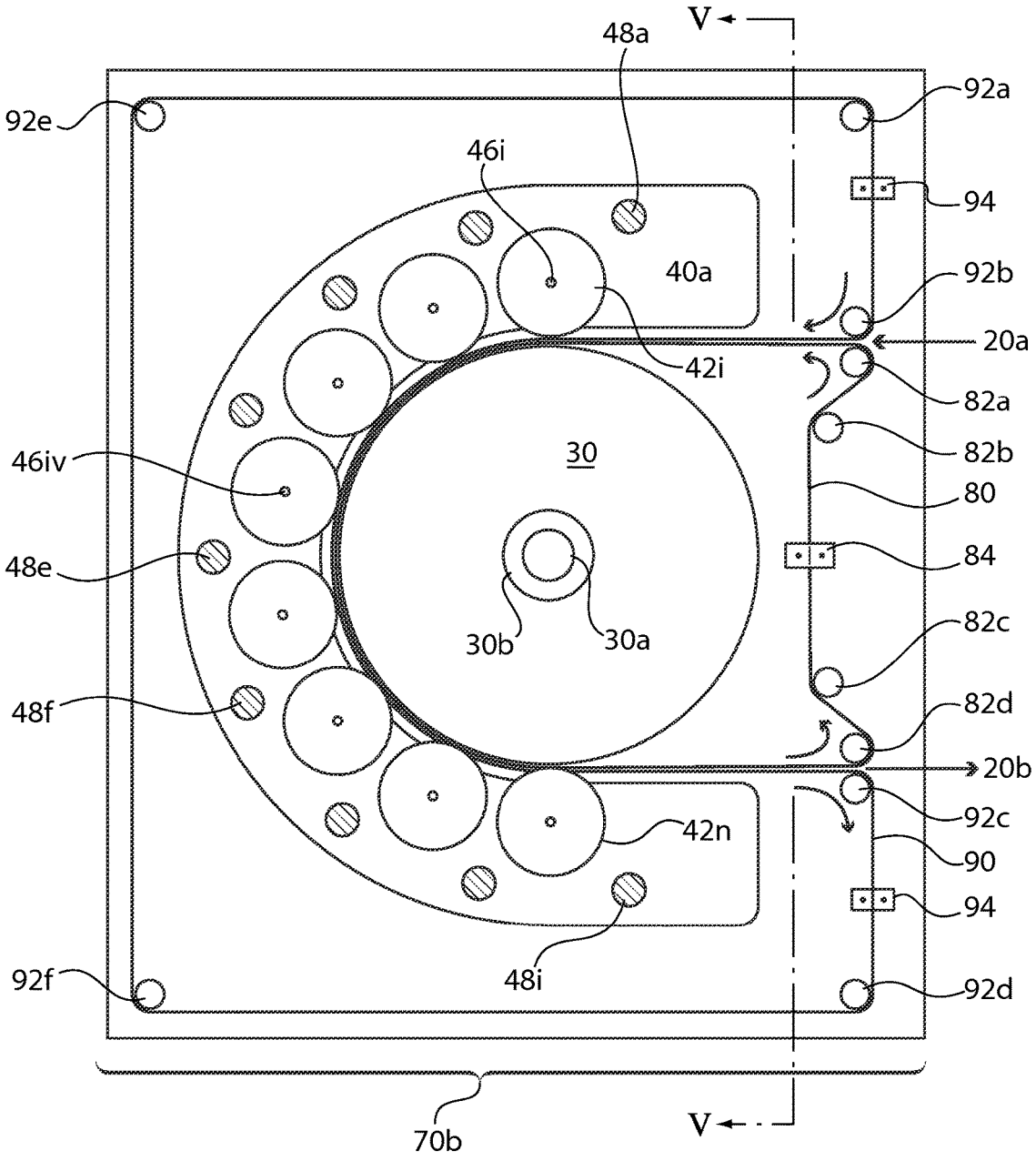
FIG. 4 is a side elevational view of a slitting apparatus equipped with a workpiece handling system.

A further embodiment with an enhanced material handling system is shown in FIG. 4. The handling system captures the material and conveys it though the slitting apparatus. The handling system is useful when slitting small materials, or when slitting webs into narrow strips. These narrow strips, or ribbons, may lack the rigidity to exit the slitting station once they are separated from the web. As an exemplary case, multi-up labels may be created by placing a series of labels across the width of the web. The web will then be slit into label strips and waste ribbons. In the case of three multi-up labels, there may be a waste ribbon on each end and in between each label strip, totaling four waste ribbons. In order to conserve resources, the waste ribbons are made as narrow as possible, for example, in the order of ¼ to inch wide. As these waste ribbons pass the final blades and become separated from the web, they can bind up or buckle within the slitting apparatus thereby failing to exit.

To form these three multi-up labels, the web needs to be minimally slit into three narrow strips. In the production of certain three-up labels, there would be waste ribbons in between each label. In other instances there would be waste ribbons at each longitudinal edge of the web. Such a slitting apparatus would need six in-line cutting assemblies. The first in-line cutting assembly removes the left edge waste ribbon; the second and third form a waste ribbon between the first and second labels; the fourth and fifth form a waste ribbon between the second and third labels; and the sixth removes the right edge. The handling system will include seven sections, alternating with the six in-line cutting assemblies.

The slitting apparatus of FIG. 4 includes a series of rods 48 that support panels 40 which hold blades 42 of the cutting assemblies. In addition, a series of rollers 82, 92 provide support for multiple sets of conveyor belts that run through the downstream direction of the slitting apparatus. The rods 48 and rollers 82, 92 are supported at each end of the slitting apparatus by support plates 70. In FIG. 4, the near support plate 70*a* has been removed, while the far support plate 70*b* can be seen in the background.

Partially surrounding the anvil cylinder is an in-line cutting assembly 40. The in-line-cutting assembly includes minimally three blades 42*i*, 42*ii*, and 42*iii*. If more blades are included they would be designated 42*i*, 42*ii* . . . 42*n* where 42*i* is the first blade to encounter material. Intermediate blades are blades 42*ii*, 42*iii*, and so on.

Figure 5:
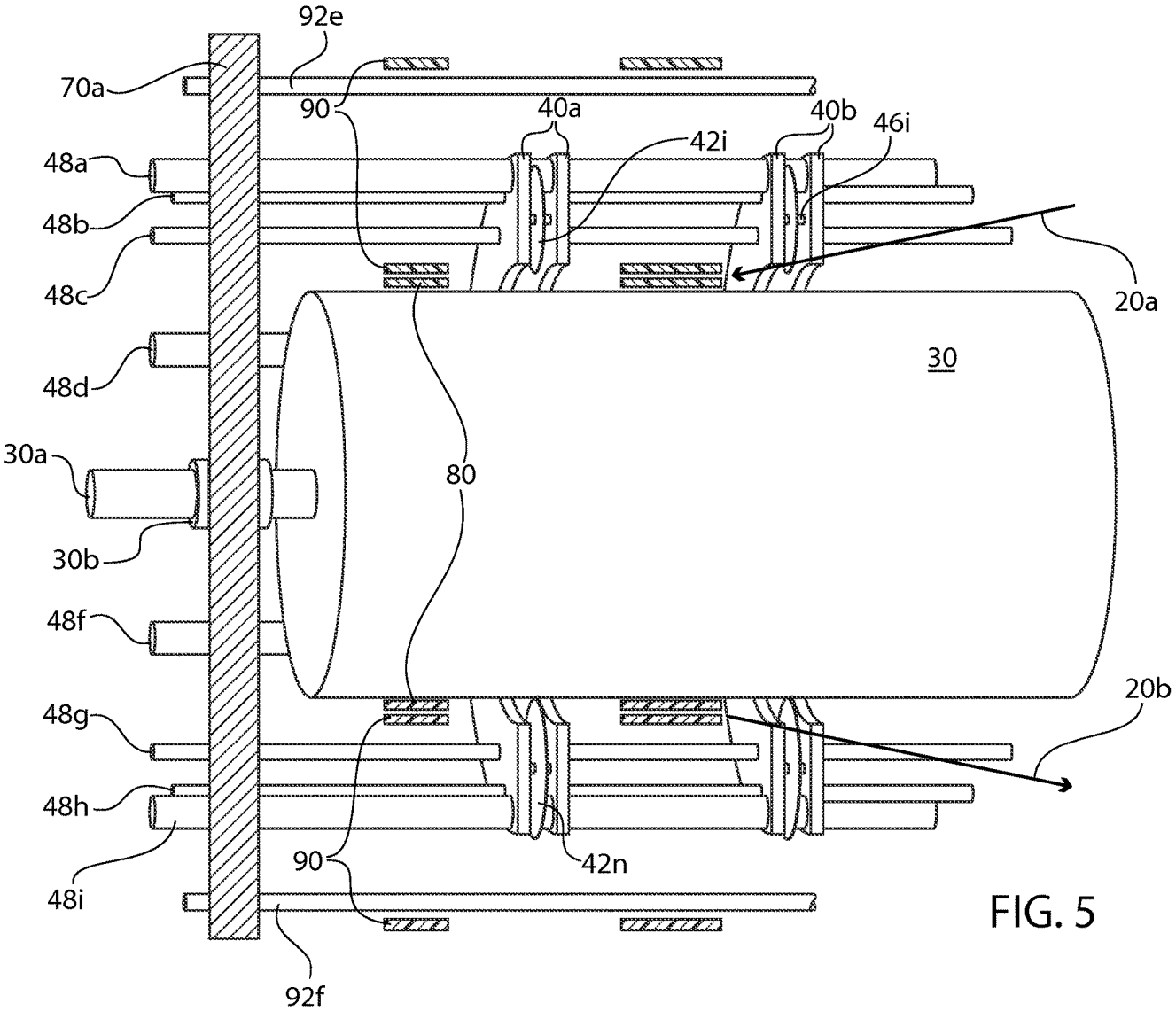
FIG. 5 is a front side elevational view showing a multiple workpiece handling system with several eating assemblies.

FIG. 5 shows a cross-sectional view through the near support plate 70*a*, the inner belt 80 and the outer belt 90. Two C-shaped arms 40*a*, 40*b* are depicted in elevation surrounding anvil cylinder 30. Each arm has two panel with a blade axle supported on both panels for mounting each blade 42. A set of guide belts 80, 90 are provided on either side of each arm. While two sets of guide belts and two arms are shown, it should be understood that any number can be provided across the width of anvil cylinder. This arrangement is useful if a web is to be slit multiple times into a number of thin ribbons. The far support plate (not shown for the sake of clarity) is located at the right of the assembly. The arms are collectively mounted on the panel rods 48*a*-48*i*. The ends of each rod are supported in the end support plates 70*a*, 70*b*.

The belts are supported on the outer cylindrical surface of anvil 30. As the outer belt 90 comes off the bottom of anvil 30, it winds down and back around outer roller 92*f*, up the back around outer roller 92*e* and then back down to the anvil 30. The path of outer belt around upper belt rollers 92*a*, 92*b* and lower belt rollers 92*c* and 92*d* is not shown in FIG. 5 for the sake of clarity. Similarly, upper inner rollers 82*a*, 82*b* and lower inner rollers 82*c* and 82*d* are not shown in FIG. 5 for the sake of clarity. In this embodiment, the outer belt circles around the outside of panel rods 48. If the panel rods are sufficiently spaces, the outer belt could pass through the rods to form a smaller loop. It should be understood that the belts are adjacent the arms and blades and therefore the location of the arms and blades do not interfere with the path of the belts.

The workpiece web enters the slitting apparatus in the infeed direction 20*a* above anvil cylinder 30 as it is grasped between outer belt 90 and inner belt 80. Where outer belt 90 is above the web, and lower belt 80 is between the web and anvil cylinder 30. As the belts wrap around anvil cylinder 30, they convey the web while pressing it against the anvil cylinder 30. Each panel 40*a* and 40*b* progressively makes a slit in the web. As the web is slit into narrow ribbons they are discharged from the slitting apparatus in the outfeed direction 20*b* below anvil cylinder 30, exiting from between inner belt 80 and outer belt 90. Where inner belt 80 is between the anvil cylinder 30 and the web. Outer belt 90 is below the web. Outer belt 90 can stretch to accommodate various thicknesses of webs, or labels or pamphlets adhered to the web.

While various embodiments of a slitting apparatus have been shown and described, it should be understood that additional configurations may be provided within the scope of the application. For example, the slitting blades may be mounted on rails or axles that are supported by end plates. The blades may be supported on arms or panels. The key feature being that the blades are in-hue and utilize a series of blades to form a single slit. In summary, the slitting apparatus includes three or more blades that form an in-line cutting assembly that wraps approximately 180 degrees around the anvil cylinder. The blade edges are tangent to an arcuate line that spirals radially inward toward the cylinder. The arm may be stationary or adjustable in one or two dimensions. Various forms of guides or belts may be provided in sections that alternate with the in-line cutting assemblies.

Having described preferred embodiments for blades, arms, mounts and adjustability (which are intended to be illustrative and not limiting), it is noted that modifications and variations can be made by persons skilled in the art in light of the above teachings. It is therefore to be understood that changes may be made in the particular embodiments of the invention disclosed which are within the scope and spirit of the invention as outlined by the appended claims. Having thus described the invention with the details and particularity required by the patent laws, what is claimed and desired protected by Letters Patent is set forth in the appended claims.

What is claimed is:

1. A slitting apparatus for slitting material fed in a downstream direction comprising:

an anvil cylinder having a central axis, a first axial end, a second axial end and a continuous outer cylindrical surface extending between said axial ends and adapted to support the material as it conveys through the slitting apparatus;

an in-line cutting assembly comprising a series of rotating circular blades with cutting edges disposed within a common plane that is oriented in between said axial ends perpendicular to the anvil cylinder's central axis; and said blades being arranged along an arcuate line that spirals inwardly toward the continuous outer cylindrical surface with each of the cutting edges being in a stationary non-overlapping position relative to said continuous outer cylindrical support surface in use whereby the blades progressively slice the material so that the in-line cutting assembly forms a singular continuous slit.

2. The slitting apparatus of claim 1, wherein the last cutting edge in the downstream direction is in contact with said continuous outer cylindrical surface.

3. The slitting apparatus of claim 1, wherein said circular blades are free spinning and rotate from contact with the material.

4. The slitting apparatus of claim 1, wherein said anvil cylinder rotates in the downstream direction to convey the material past cutting edges that are progressively closer to continuous outer cylindrical surface.

5. The slitting apparatus of claim 4, wherein the first cutting edge to encounter the material slices a layer of the material that is furthest from the anvil cylinder.

6. The slitting apparatus of claim 4, comprising a motor for rotating said anvil cylinder.

7. The slitting apparatus of claim 6, wherein the material comprises a web, and wherein said motor is adapted to rotate said anvil cylinder so that said continuous outer cylindrical surface moves at a speed equal to the web speed.

8. The slitting apparatus of claim 1, further comprising a guide disposed lateral of said in-line cutting assembly to direct the material around the anvil cylinder as it conveys in the downstream direction.

9. The slitting apparatus of claim 8, wherein said guide includes belts that partially wrap around said anvil cylinder to hold material in contact with said anvil cylinder.

10. The slitting apparatus of claim 9, wherein said guide includes an inner belt that encircles said anvil cylinder and outer belt that overlies said inner belt in a region adjacent said series of rotating circular cutting blades, whereby said inner belt and said outer belt sandwich the material to hold it flat against said continuous outer cylindrical surface.

11. A slitting apparatus for slitting a material web fed in a downstream direction comprising:

an anvil cylinder having a central axis, a first axial end, a second axial end and a continuous outer cylindrical surface extending between said axial ends and adapted to support the material web as it conveys through the slitting apparatus;

an in-line cutting assembly comprising a series of rotating circular blades with cutting edges disposed within a common plane that is oriented in between said axial ends perpendicular to the anvil cylinder's central axis; and said blades being arranged along an arcuate line that spirals inwardly toward the continuous outer cylindrical surface with each of the cutting edges being in a stationary non-overlapping position relative to said continuous outer cylindrical support surface in use whereby the blades progressively slice the material so that the in-line cutting assembly forms a singular continuous slit.

12. A slitting apparatus for slitting a material fed in a downstream direction comprising:

an anvil cylinder having a central axis, a first axial end, a second axial end and a continuous outer cylindrical surface extending between said axial ends and adapted to support the material as it conveys through the slitting apparatus;

an in-line cutting assembly comprising a series of rotating circular blades with cutting edges disposed within a common plane that is oriented in between said axial ends perpendicular to the anvil cylinder's central axis; and said blades being arranged along an arcuate line that spirals inwardly toward said continuous outer cylindrical surface with each of the cutting edges being in a stationary non-overlapping position relative to said continuous outer cylindrical support surface in use, wherein the last cutting edge in the downstream direction is in contact with said continuous outer cylindrical surface whereby the blades progressively slice the material so that the in-line cutting assembly forms a singular continuous slit.

13. A slitting apparatus for slitting a material web fed in a downstream direction comprising:

an anvil cylinder having a central axis, a first axial end, a second axial end and a continuous outer cylindrical surface extending between said axial ends and adapted to support the material web as it conveys through the slitting apparatus;

an in-line cutting assembly comprising a series of rotating circular blades with cutting edges disposed within a common plane that is oriented in between said axial ends perpendicular to the anvil cylinder's central axis; and said blades being arranged along an arcuate line that spirals inwardly toward said continuous outer cylindrical surface with each of the cutting edges being in a stationary non-overlapping position relative to said continuous outer cylindrical support surface in use, wherein the last cutting edge in the downstream direction is in contact with said continuous outer cylindrical surface whereby the blades progressively slice the web material so that the in-line cutting assembly forms a singular continuous slit.

* * * * *